US006747568B1

(12) United States Patent
Teskey

(10) Patent No.: US 6,747,568 B1
(45) Date of Patent: Jun. 8, 2004

(54) REMOTE CONTROL CODE SEARCH METHOD AND APPARATUS

(75) Inventor: John Frederick Teskey, Indianapolis, IN (US)

(73) Assignee: Thomson Licensing S.A., Boulogne (FR)

( * ) Notice: Subject to any disclaimer, the term of this patent is extended or adjusted under 35 U.S.C. 154(b) by 0 days.

(21) Appl. No.: 09/581,741

(22) PCT Filed: Dec. 19, 1997

(86) PCT No.: PCT/US97/23366

§ 371 (c)(1),
(2), (4) Date: Nov. 13, 2000

(87) PCT Pub. No.: WO99/33192

PCT Pub. Date: Jul. 1, 1999

(51) Int. Cl.[7] ..... G08C 19/00
(52) U.S. Cl. ..... 340/825.72; 340/825.69; 340/825.24; 348/734; 341/176
(58) Field of Search ..... 340/825.72, 825.69, 340/825.24; 348/734; 341/176

(56) References Cited

U.S. PATENT DOCUMENTS 4,703,359 A * 10/1987 Rumbolt et al. ..... 348/734
4,746,919 A * 5/1988 Reitmeier ..... 340/825.56
5,614,906 A * 3/1997 Hayes et al. ..... 341/176
5,910,784 A * 6/1999 Lai ..... 341/176

FOREIGN PATENT DOCUMENTS

EP 122548 4/1984 ..... H04B/1/20
EP 223307 5/1987 ..... H04B/1/20

OTHER PUBLICATIONS

European Search Report dated Aug. 6, 1998.

* cited by examiner

*Primary Examiner*—Michael Horabik
*Assistant Examiner*—Yves Dalencourt
(74) *Attorney, Agent, or Firm*—Joseph S. Tripoli; Paul P. Kiel

(57) ABSTRACT

A universal remote control and a method for programming a universal remote control allows a user to quickly and easily identify a set of remote control signal formats that include a desired signal format and then individually test the signal formats in the identified set to identify the desired signal format. A reference code, or other identification information, associated with the desired signal format. In the code search mode of operation, the present universal remote control generates and transmits one of a plurality of sets of signal formats stored in a memory circuit (RAM,ROM) in response to the user pressing a first control key (76). The user repeatedly presses the first control key and observes the controlled device to identify a set of signal formats that includes the desired signal format. After the desired set of signal formats is identified, the user presses either a second or a third control key (74,78) to individually transmit each signal format in the identified set of signal formats. The user repeatedly presses the second and third control keys and observes the controlled device to identify the desired signal format.

10 Claims, 3 Drawing Sheets

REMOTE CONTROL CODE SEARCH METHOD AND APPARATUS

The present invention relates to remote controls for operating electronic devices, and more particularly to universal remote controls which can be programmed to operate one of a plurality of different types of electronic devices produced by different manufacturers.

Universal remote controls are well known devices which can be programmed by a user to operate one of a plurality of different types of electronic devices produced by different manufacturers. Universal remote controls are often used to control audio/video equipment, such as TVs, VCRs, CD players and the like. Due to their programmability, consumers frequently use universal remote controls to replace lost remote controls and/or as a single control device for controlling a number of separate audio/video components.

Prior to use, a universal remote control typically must be programmed for operation with the electronic device being controlled. Programming a universal remote control generally involves identifying and storing a reference code, or some other identification information, associated with the correct signal format into a memory circuit of the universal remote control. Once programmed, the universal remote control transmits control signals having a signal format that is appropriate for the device being controlled. The signal format is determined by characteristics which include, but are not limited to, carrier frequency, pulse width, pulse modulation and overall timing.

Several methods are available for programming a universal remote control to transmit control signals having the desired signal format. One method is to manually enter the reference code associated with the controlled device. In such a method, a list of reference codes for a variety of device models is included in the printed instruction set that accompanies the universal remote control. The user finds the reference code associated with the device to be controlled and manually enters the code numbers using a numeric keypad disposed on the universal remote control. This method can be problematic for the user because the specific reference code numbers must be known in order to program the universal remote control. Thus, the reference code list must be kept nearby and consulted whenever a new code must be entered or a particular code needs to be reentered.

Another method of programming a universal remote control is an automatic code searching and storing method. In this method, the universal remote control automatically and continuously passes through a set of signal formats by sequentially sending remote control signals based on each of the signal formats in a stored list until the user stops the signal format search sequence. The user initiates and maintains the automatic search sequence by pressing a designated set of keys. During the cycling of the signal formats, the remote control pauses between each signal format allowing the user to observe whether the controlled device reacts to a particular signal format. When the controlled device reacts to the remote control signal in the desired manner, the user knows that the correct signal format, and thus the correct reference code, has been identified and terminates the automatic search sequence. Terminating the search sequence causes the universal remote control to stop cycling through the signal formats and store the reference code, or other identifying information, associated with the most recently transmitted signal format into a memory circuit.

An example of a system that employs such a method is disclosed in EP-A-0 233 307. The disclosed system is a remote control apparatus which, in response to a first input, generates and transmits a sequence of remote control signals, each of the signals in a different format. The user observes the appliance and waits for the appliance to react in an expected manner. When the appliance reacts, the user provides a second input that causes the remote control apparatus to save the last signal format transmitted.

A disadvantage of the automatic search method is that such a method requires the user to react within a predetermined pause period. The user must react within the allotted pause period when the device reacts as expected to a remote control signal in order to stop the cycling of the signal formats and store reference code associated with the desired signal format into a memory circuit. If the user is distracted and/or reacts too slowly, the improper reference code will be stored in memory and the user must repeat the code search operation to find and store the correct reference code. It can be seen that this method becomes difficult and frustrating to use if the user is repeatedly unable to react within the allotted pause periods.

Yet another method of programming a universal remote control is a semi-automatic code search method in which the user steps through a plurality of signal formats stored in a memory portion until the desired signal format is found. In this method, the user steps through a set of signal formats stored in memory by transmitting a sequence of remote control signals, one at a time, wherein each transmitted remote control signal has a different signal format, by pressing a designated set of keys. After each remote control signal format is transmitted, the user observes whether the device reacts to the transmitted signal, i.e., power ON/OFF or channel UP/DOWN. When the device reacts to the signal in the expected manner, the user knows that the appropriate signal format has been transmitted. At this point, the user presses another set of keys to terminate the code search operation and store the reference code, or other identifying information, associated with the last transmitted signal format into a memory circuit.

A difficulty with the above-described method is that the user may be forced to step through a large number of signal formats before identifying the correct signal format because there may be a large number of signal format possibilities stored in the memory circuit. In fact, the reference codes are getting longer, moving from two digits to three and four digits, due to the longer list of formats available. It can be seen that such a difficulty can make this method tedious and time consuming. This is especially problematic if the desired signal format is stored near the end of the signal format list.

What is needed is an improved method of quickly and easily programming a universal remote control to transmit remote control signals in a desired signal format. In particular, it is desired to be able to program a universal remote control without having to refer to a printed list of reference codes and manually enter a specific reference code into the universal remote control. It is also desired to be able to program a universal remote control by cycling through a set of stored signal formats wherein the user can quickly, easily and efficiently control the rate at which the stored signal formats are transmitted and tested.

The present invention involves a universal remote control and a method for programming a universal remote control which allows a user to quickly and easily test a set of stored signal formats to identify the desired signal format and store a reference code, or other identifying information, associated with the desired signal format into a memory circuit such that subsequent remote control signals will be transmitted in the desired signal format.

The present universal remote control comprises a signal transmitter, data entry means for allowing a user to enter data and one of a plurality of code search commands, a memory circuit, and a controller. The controller generates and applies one of a plurality of sets of remote control signals to the signal transmitter in response to user entry of a first code search command. Each of the sets of remote control signals comprises a plurality of remote control signals and each of the remote control signals has a respective signal format based on a list of signal formats stored in the memory circuit. The controller also generates and applies one of the remote control signals from the most recently transmitted set of remote control signals in response to user entry of a second code search command. The controller stores an identification information associated with a most recently transmitted signal format in response to user entry of a code search exit command. Advantageously the controller generates and applies the remote control signals from the most recently transmitted set of remote control signals to the signal generator, in a first predetermined order, in response to each user entry of the second code search command, and generates and applies the remote control signals from the last transmitted set of remote control signals to the signal generator, in a second predetermined order, in response to each user entry of a third code search command.

The present invention allows a user to quickly identify a set of signal formats which includes the desired signal format by entering the first code search command, and then quickly identify the specific, desired signal format from the identified set of signal formats by entering the second and third code search commands keys.

The present invention also involves a method for programming a universal remote control comprising the steps of identifying a signal set which includes a desired signal format by transmitting a plurality of signal sets until the controlled device observably responds in an expected manner, identifying the desired signal format in the identified signal set by individually transmitting the remote control signal formats included in the identified signal set until the controlled device observably responds in an expected manner, and storing an identifying information, such as a reference code, associated with the identified signal format in a memory circuit.

The invention will be described with reference to the accompanying drawings, wherein.

Figure 1:
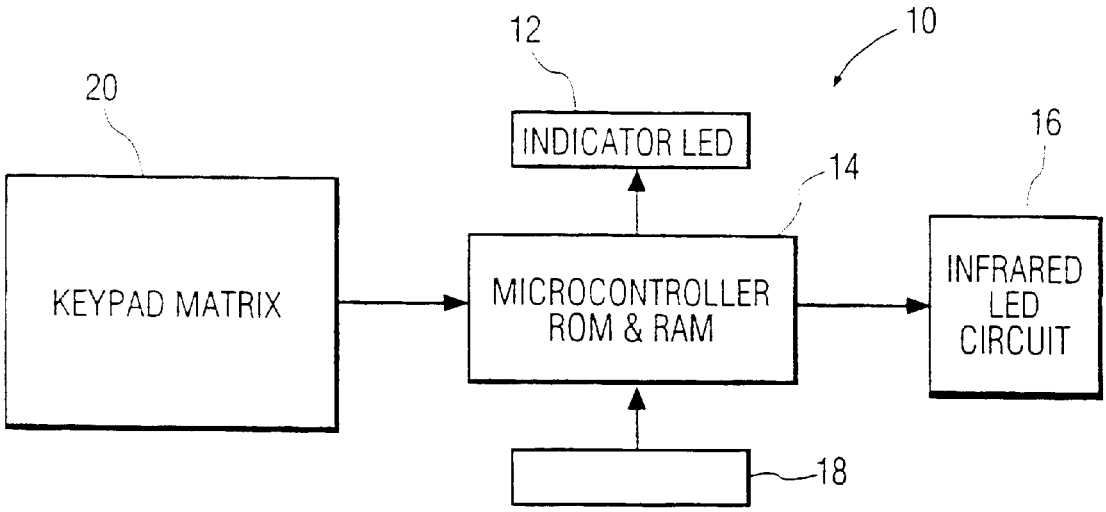
FIG. 1 is a simplified block diagram of the elements in the present universal remote control.

Referring to FIG. 1, there is shown a simplified block diagram of universal remote control 10. The elements within universal remote control 10 and their operation in generating and transmitting remote control signals for controlling electronic devices are known in the art and will not be discussed in detail here.

Generally, user input is received through keypad matrix 20 which includes various control keys, device selection keys, numerical keys, transport keys and the like. Microcontroller 14 receives the user input and generates an appropriate remote control signal having the required signal format. Microcontroller 14 generates the remote control signals in accordance with the designated reference code by looking up the associated signal format information stored in the RAM and/or ROM to produce the correct signal format from the product code look up tables. It is to be understood that the RAM and ROM may be either internal or external to microcontroller 14. It is also to be understood that reference code refers to any identifying information which may be stored in the universal remote control and can be associated with a particular signal format. Signal format characteristics include, but are not limited to, carrier frequency, pulse width, pulse modulation and overall signal timing information.

Microcontroller 14 applies the remote control signal to infrared LED circuit 16 to transmit the remote control signal to the controlled device. The remote control signal may also be transmitted using any suitable method, including, but not limited to RF transmissions. Microcontroller 14 also lights up indicator LED 12 to indicate that a remote control signal has been transmitted. Indicator LED 12 may comprise a plurality of LEDs that are controlled as required during the remote control programming procedures as described further below. Crystal oscillator 18 generates a clock signal which controls the rate and timing of operation performed by microcontroller 14.

Figure 3:
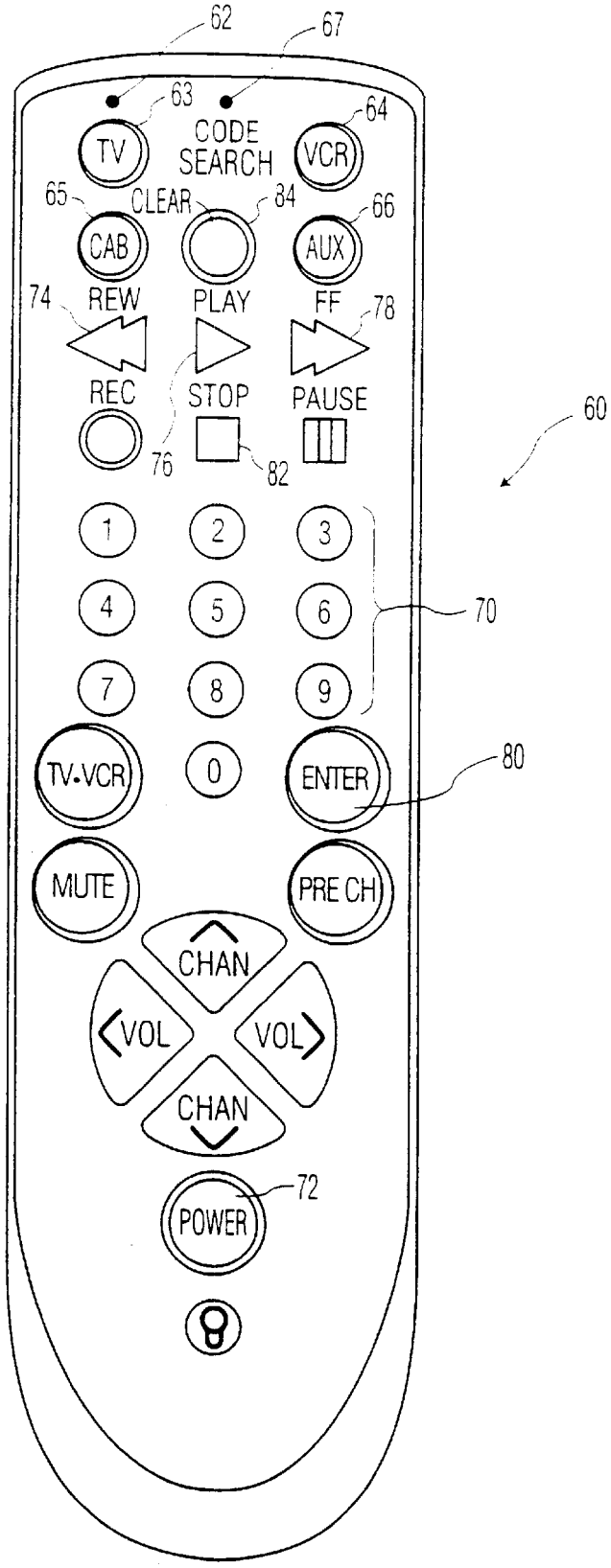
FIG. 3 is a top plan view of a suitable universal remote control layout for implementing the present invention.

A universal remote control which includes a numeric and control button keypad layout 60 suitable for use with the present reference code search method is illustrated in FIG. 3. Again, reference code search refers to the identification and storage of a reference code, or any other identifying information, which is associated with a particular device and/or signal format and allows microcontroller 14 to look up the desired information to generate a remote control signal having the desired signal format. Universal remote controls which generally include the elements described above and a suitable keypad layout include, but are not limited to, CRK76TA1, CRK76TBL1, CRK76TCL1 and CRK76TD1 manufactured by THOMSON CONSUMER ELECTRONICS of Indianapolis, Ind.

As shown in FIG. 3, keypad layout 60 includes LED 62 and LED 67. LED 62 visibly indicates when various operations occur, for example, keypad entry, and remote control signal transmission. LED 67 provides visible indications during the code search mode of operation. However, it is to be understood that the indication functions may be provided by a single LED or any combinations of LEDs. Keypad layout 60 also includes numeric keypad 70, a plurality of device keys 63–65 for selecting the device to be controlled by remote control 10. Transport keys 74, 76, 78 and 82 are used to control the operation of a videocassette recorder, as well as during the reference code search procedure as described further below. Power key 72 is used to turn a selected device ON and OFF.

In addition to the conventional functions associated with the various keys on keypad layout 60, a number of keys are associated with code search functions when universal remote control 10 operates in the code search mode. However, it is to be understood that although the preferred embodiment associates certain keys with certain functions, the invention is not limited to any specific associations between particular keys and code search commands.

In the preferred embodiment, a user configures universal remote control 10 for the code search mode by pressing one of the device keys 63–65 and power key 72 at the same time until LED 67 illuminates. The device key and power key 73 may be released once LED 67 illuminates and LED 67 remains illuminated while universal remote control 10 is operating in the code search mode. Additionally, LED 67 flashes OFF and ON each time the user presses a key and each time a remote control signal is transmitted while in the code search mode so the user can verify the operation of universal remote control 10.

Transport keys 74, 76 and 78 are used to cause universal remote control 10 to transmit various remote control signals having respective signal formats based on a list of signal formats stored in ROM as described below.

In the code search mode, each time the user presses PLAY key 76, universal remote control 10 transmits one of a plurality of sets of remote control signals. Each set of remote control signals includes a predetermined number of remote control signals, in this case 10 signals, wherein each remote control signal uses a respective signal format taken from the list of signal formats stored in ROM. Universal remote control 10 pauses about 5 seconds between each remote control signal transmission and LED 67 will flash OFF and ON each time one of the remote control signals in the set of signals is transmitted. If the user presses PLAY key 76 after universal remote control 10 has cycled through the entire list of stored signal formats, universal remote control 10 wraps back up to the first signal format in the stored list. Alternatively, an indicator may be provided to indicate that the last set of signal formats has been reached.

It can be seen that a user can quickly test a set of signals to determine whether the set includes a signal that uses the correct signal format by pressing PLAY key 76 and observing the controlled device. In the preferred embodiment, universal remote control 10 transmits a power OFF signal when the user presses PLAY key 76, thus the user observes whether the controlled device turns OFF in response.

Also in the code search mode, the user may press either FF key 78 or REW key 74 to individually test the signal formats used in the most recently transmitted set of signals. When the user initially presses FF key 78 after having pressed another control key, universal remote control 10 generates and transmits a power ON signal using the most recently transmitted signal format. Thereafter, when the user presses FF key 78, universal remote control key 10 generates and transmits a power ON signal using the signal format immediately following the last transmitted signal format in the set of signals transmitted during the last activation of PLAY key 76. If the most recently transmitted signal format is the last signal format of the 10 signal formats in the set of signals, universal remote control 10 wraps around and transmits a power ON signal using the first signal format in the set of signals.

When the user initially presses REW key 74 after having pressed another control key, universal remote control 10 generates and transmits a power ON signal using the last signal format transmitted. Thereafter, when the user presses REW key 74, universal remote control 10 generates and transmits a power ON signal based on a signal format immediately previous to the most recently transmitted signal format used in the set of signals transmitted during the last activation of PLAY key 76. If the last transmitted signal format is the first signal format of the 10 signals in the set of signals, universal remote control 10 wraps around and transmits a signal using the last signal format in the set of signal formats.

Therefore, the user can individually check the signal formats used in an identified set of signals in both the forward and reverse directions. After pressing either FF key 78 or REW key 74, the user observes whether the controlled device responds to the power ON signal. When the controlled device responds as expected the user knows that the most recently transmitted signal format is the correct format for the particular device.

To exit the code search mode, the user can press either STOP key 82 or CLEAR key 84 until LED 67 turns OFF. Pressing STOP key 82 until LED 67 turns OFF causes universal remote control 10 to store the reference code associated with the most recently transmitted signal format into a memory circuit and exit the code search mode. Subsequent remote control signals will be transmitted in accordance with the stored reference code. Pressing CLEAR key 84 causes universal remote control 10 to exit the code search mode without storing the reference code associated with the last transmitted signal format.

Figure 2:
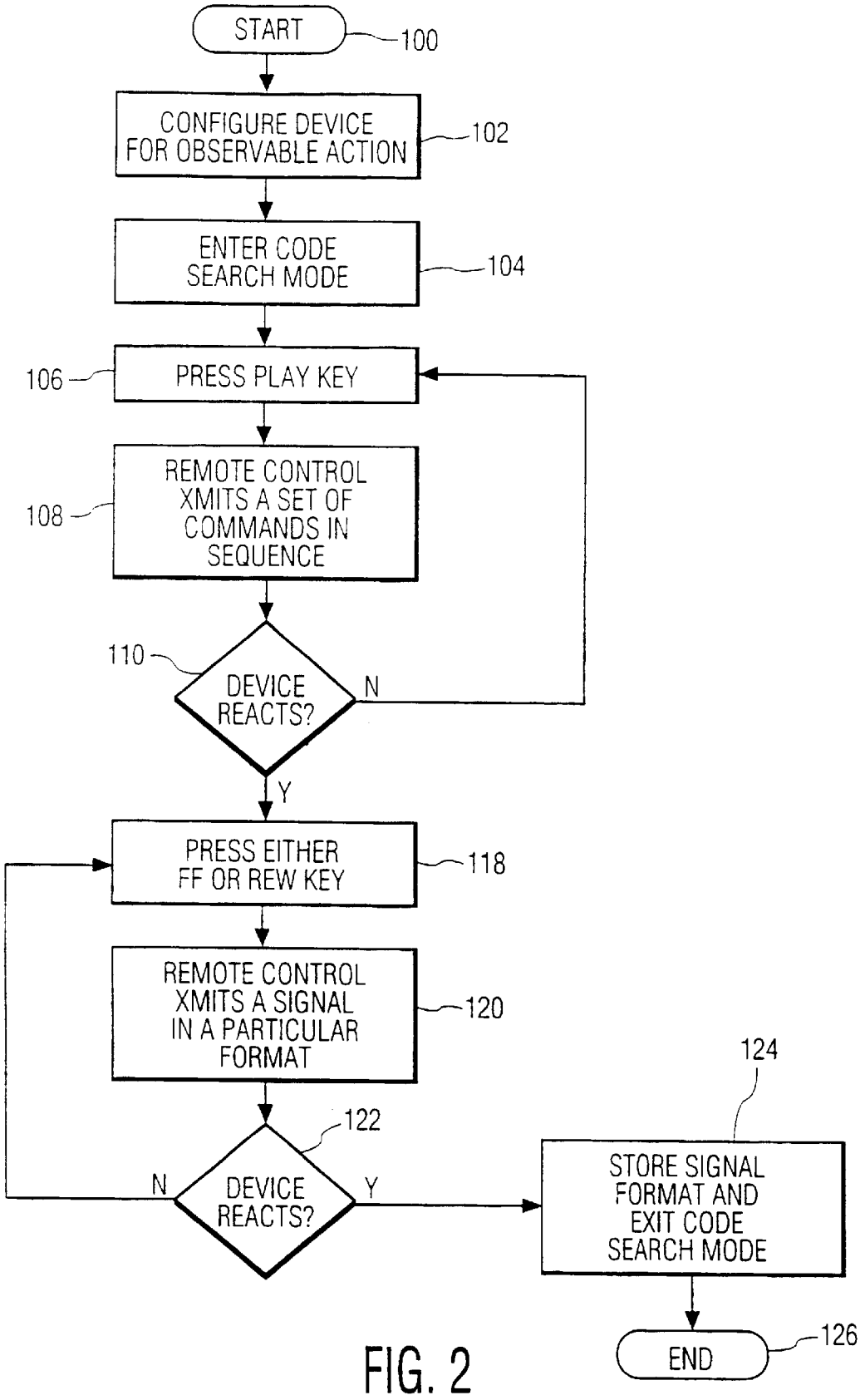
FIG. 2 is a flowchart diagram showing the steps for programming a universal remote control in accordance with a method of the present invention.

The present code search method for identifying and storing a desired reference code is now described with reference to FIG. 2. Initially the user enters the procedure at step 100 and configures the device for observable operation in step 102. In the exemplary embodiment, the user configures the device by turning ON the device and positioning it so that the user can readily observe whether the device turns ON or OFF in response to the code search procedure. In step 104, the user enters the code search mode by pressing and holding down one of the devices keys 63–65, depending on the device to be controlled, and power key 72 until code search LED 67 turns ON.

In step 106, the user begins testing the signal formats stored in universal remote control 60 by pressing PLAY key 76. When PLAY key 76 is pressed, universal remote control 60 generates and transmits 10 power OFF signals as described above. After pressing PLAY key 76, the user waits an appropriate period of time, about 5 seconds, and observes in step 110 whether the device turns OFF in reaction to the transmitted set of power OFF signals. If the device turns OFF, the user knows that the transmitted set of power OFF signals includes a remote control signal having the desired signal format. If the device does not turn OFF, the user returns to step 106 to press the PLAY key 76 again and observe whether the device reacts as desired. Steps 106, 108 and 110 are repeated until the device reacts as desired. Optionally, universal remote control 60 may be configured to provide an indication to the user if all of the stored signal formats have been transmitted, for example by flashing LED 67 in a particular manner.

When the device turns OFF, the user goes to step 118 to determine the specific signal format from the set of signal formats identified in steps 106–110. In step 118. the user presses either FF key 78 or REW key 74 to individually test the signal formats used in the identified set of signals. In step 120, universal remote control 60 transmits a power ON signal as described above in response to the user pressing either FF key 78 or REW key 74, thereby allowing the user to step through each of the signal formats used in the identified set of signals.

After pressing either FF key 78 or REW key 74, the user observes the device to determine whether the transmitted signal format is the desired format. If the device reacts as desired, in this case turn ON, as determined in step 122, the user knows that the desired signal format has been transmitted. Otherwise, the user knows that the desired signal format has not been transmitted and returns to step 118 to repeat the process of transmitting another signal format and observing the device. The user repeats this process until the device reacts as desired.

When the device reacts as desired and the user knows that the correct signal format has been identified, the user can exit the code search mode in step 124 by pressing STOP key 82 or CLEAR key 84. As noted above, pressing STOP key 82 causes universal remote control 10 to store the reference code associated with the identified signal format and exit the code search mode, while pressing CLEAR key 84 causes universal remote control 10 to exit the code search mode without storing the reference code.

It can be seen that by transmitting a set of signal formats when the user presses PLAY key 76, an appropriate set of signal formats can be quickly and easily identified. Once the user has identified the appropriate set of signal formats, the user can press either FF key 78 or REW key 74 as desired to test each signal format in the set of signal formats to quickly identify the desired signal format. In this manner, the user easily and efficiently controls the pace at which the various signal formats are transmitted. After the correct signal format has been identified, the user can store the associated reference code so that subsequent remote control signals will be based on the stored signal format.

Additionally, universal remote control 10 may incorporate other programming methods including, but not limited to, the direct, manual entry method, the automatic method and the manual stepping method wherein the user steps through each signal format stored in ROM by repeatedly pressing power key 72.

It is to be understood that the present method may be implemented using a number of techniques and/or programming languages known to one of ordinary skill in the art, including, but not limited to programming microcontroller 14 using assembly language, C and C++.

It will be apparent to those skilled in the art that although the invention has been described in terms of a specific example, modifications and changes may be made to the disclosed embodiment without departing from the essence of the invention. For example, the control keys for transmitting a set of signal formats or an individual signal format may be implemented with various other keys on a universal remote control. Additionally, the number of signal formats used in a set of signal formats may be varied by the user to more quickly and easily locate a desired set of signal formats. Also, commands other than power ON/OFF, including user designated commands, may be used to test the stored list of signal formats. Therefore, it is to be understood that the present invention is intended to cover all modifications which naturally flow from the foregoing and example.

What is claimed is:

1. A remote control apparatus, comprising:

a signal transmitter;

data entry means for allowing a user to enter data and commands, including one of a plurality of code search commands;

a memory circuit; and a controller operatively coupled to said signal transmitter, said data entry means, and said memory circuit, said controller causing said signal transmitter to transmit a sequence of remote control signals during a code search mode of operation, said controller storing in said memory circuit an identification information associated with a most recently transmitted signal format in response to user entry of a code search stop command (STOP), wherein said controller causes said signal transmitter to transmit one of a plurality of sets of remote control signals in response to user entry of a first code search command (PLAY), each of said sets of remote control signals comprising a plurality of remote control signals, each one of said remote control signals in each of said sets being associated with a respective one of a plurality of signal formats stored in said memory circuit.

2. The remote control apparatus according to claim 1, wherein said controller causes said signal transmitter to transmit one of said remote control signals from a most recently transmitted set of remote control signals in response to user entry of a second code search command (FF).

3. The remote control apparatus according to claim 2, wherein said controller causes said signal transmitter to transmit said remote control signals from said most recently transmitted set of remote control signals, in a first predetermined order, in response to each user entry of said second code search command (FF).

4. The remote control apparatus according to claims 3, wherein said controller causes said signal transmitter to transmit said remote control signals from said most recently transmitted set of remote control signals, in a second predetermined order, in response to each user entry of a third code search command (REW).

5. The remote control apparatus according to claim 1, wherein said controller causes said signal transmitter to sequentially transmit each of said remote control signals of said sets of remote control signals with a predetermined time period between each of said remote control signals in response to user entry of said first code search command (PLAY).

6. The remote control apparatus according to claim 1, further comprising an indicator operatively coupled to said controller, said indicator providing an indication to the user each time said controller causes said signal transmitter to transmit one of said remote control signals.

7. The method for programming a remote control apparatus to control one of a plurality of devices, comprising the steps of:

transmitting a sequence of remote control signals to a device to be controlled in response to user entry of a first code search command (PLAY) during a code search mode of operation, the sequence of remote control signals adapted to provide an observable response to a user;

storing the identification information associated with a most recently transmitted signal format in response to user entry of a code search stop command; and generating and transmitting remote control signals in accordance with the identification information to control the device, wherein the transmitting step comprises transmitting one of a plurality of sets of remote control signals to the signal transmitter in response to user entry of a first code search command, each of the sets of remote control signals comprising a plurality of remote control signals, each of the remote control signals in each of the sets being associated with a respective one of a plurality of signal formats stored in a memory circuit of a remote control apparatus.

8. The method according to claim 7, wherein the transmitting step comprises sequentially transmitting a predetermined number of remote control signals with a predetermined time period between each of the remote control signals.

9. The method according to claim 8, further comprising the step of: transmitting each one of the remote control signals in the most recently transmitted set of remote control signals, in a first predetermined order, in response to each user entry of a second code search command whereby a desired one of the remote control signal in the most recently transmitted set may be identified.

10. The method according to claim 9, further comprising the step of: transmitting each one of the remote control signals in the most recently transmitted set of remote control signals, in a second predetermined order, in response to each user entry of a third code search command, whereby a desired one of the remote control signal is the most recently transmitted set may be identified.

* * * * *